US007588171B2

(12) United States Patent
Reedy et al.

(10) Patent No.: US 7,588,171 B2
(45) Date of Patent: Sep. 15, 2009

(54) ACTUATOR FOR AN AEROSOL CONTAINER

(75) Inventors: Michael Herschel Reedy, Chicago, IL (US); Taiwon Choi, Chicago, IL (US); Ravi Itiravivong, Chicago, IL (US); Darren Stoddart, Fenton, MO (US); Robin Spence, Florissant, MO (US)

(73) Assignee: Masterchem Industries LLC, Imperial, MO (US)

( * ) Notice: Subject to any disclaimer, the term of this patent is extended or adjusted under 35 U.S.C. 154(b) by 555 days.

(21) Appl. No.: 11/519,409

(22) Filed: Sep. 12, 2006

(65) Prior Publication Data

US 2008/0061087 A1 Mar. 13, 2008

(51) Int. Cl.
*B67B 5/00* (2006.01)

(52) U.S. Cl. ..... 222/153.11; 222/402.11; 222/402.13

(58) Field of Classification Search ..... 222/153.01, 222/153.1, 153.11–153.14, 182, 384, 402.11, 222/402.13, 402.15
See application file for complete search history.

(56) References Cited

U.S. PATENT DOCUMENTS

| | | | | | |
|---|---|---|---|---|---|
| 2,829,801 | A | | 4/1958 | Ayres | |
| 3,272,390 | A | | 9/1966 | Horwitt | |
| 3,404,814 | A | * | 10/1968 | Wakeman | 222/402.13 |
| 3,593,926 | A | | 7/1971 | Kozub | |
| 3,608,785 | A | * | 9/1971 | Durso et al. | 222/182 |
| 3,622,052 | A | | 11/1971 | Gach | |
| 3,734,354 | A | | 5/1973 | Gach | |
| 3,738,537 | A | | 6/1973 | Gach | |
| 3,749,286 | A | | 7/1973 | Douglas | |
| 3,760,988 | A | | 9/1973 | Ostrowsky | |
| 3,779,427 | A | | 12/1973 | Ewald | |
| 3,828,982 | A | * | 8/1974 | Steigerwald | 222/153.11 |
| 3,837,537 | A | | 9/1974 | Baldwin | |
| 3,894,665 | A | | 7/1975 | Swenson | |
| 3,915,354 | A | | 10/1975 | Lo | |
| 3,918,614 | A | | 11/1975 | Steiman | |
| 3,940,023 | A | * | 2/1976 | Umstead | 222/153.11 |
| 3,967,760 | A | | 7/1976 | Marcon | |
| 4,024,988 | A | | 5/1977 | Starrett | |
| 4,325,497 | A | | 4/1982 | Ewald | |
| 4,582,228 | A | | 4/1986 | Diamond et al. | |
| 5,282,551 | A | * | 2/1994 | Pierson | 222/153.11 |
| 6,398,082 | B2 | | 6/2002 | Clark et al. | |

FOREIGN PATENT DOCUMENTS

| | | |
|---|---|---|
| DE | 4400605 A1 | 7/1995 |

* cited by examiner

*Primary Examiner*—Kevin P Shaver
*Assistant Examiner*—Andrew P Bainbridge
(74) *Attorney, Agent, or Firm*—Reising Ethington PC

(57) ABSTRACT

An actuator for an aerosol container having a valve with a projecting valve stem includes an actuator button having an outlet for coupling to the valve stem. A crossbar is disposed between the container and the actuator button. The crossbar is movable with respect to the valve stem between at least a first position blocking depression of the actuator button with respect to the valve stem and a second position permitting depression of the actuator button with respect to the valve stem. The crossbar preferably can be moved from either side of the actuator, and one or more springs preferably are carried by the crossbar for engaging the container and biasing the crossbar to the first or blocking position.

10 Claims, 5 Drawing Sheets

ACTUATOR FOR AN AEROSOL CONTAINER

The present disclosure relates to an actuator for an aerosol container, such as a spray paint can for example, and more particularly to an aerosol actuator having a child-resistance mechanism for releasably blocking depression of the actuator button and/or a mechanism for releasably locking the actuator button in the depressed or activated position.

BACKGROUND AND SUMMARY OF THE DISCLOSURE

A general object of the present disclosure is to provide an actuator for an aerosol container that includes a child-resistance mechanism for releasably blocking depression of the actuator button and/or a mechanism for releasably locking the actuator button in the depressed or activated position.

The present disclosure embodies a number of aspects that can be implemented separately from or in combination with each other.

An actuator for an aerosol container having a valve with a projecting valve stem, in accordance with one aspect of the present disclosure, includes an actuator button having an outlet for coupling to the valve stem. A crossbar is disposed between the container and the actuator button. The crossbar is movable with respect to the valve stem between at least a first position blocking depression of the actuator button with respect to the valve stem and a second position permitting depression of the actuator button with respect to the valve stem. The crossbar preferably can be moved from either side of the actuator, and one or more springs preferably are carried by the crossbar for engaging the container and biasing the crossbar to the first or blocking position.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
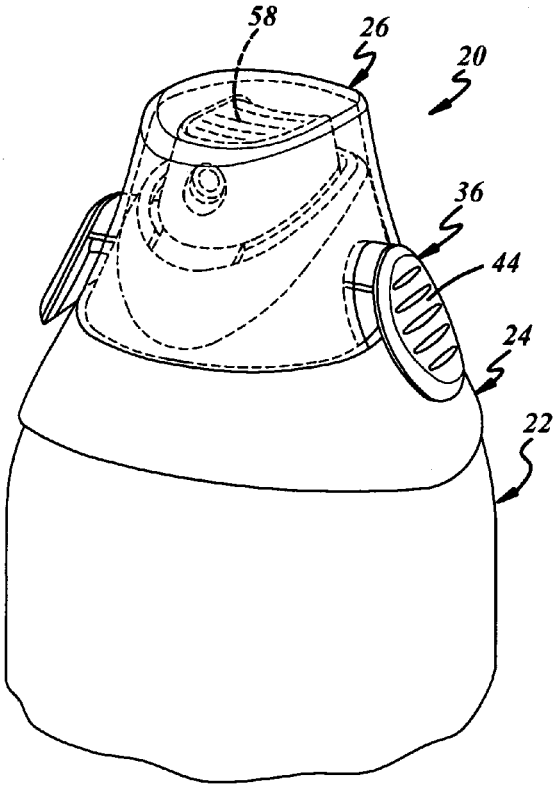
FIG. 1 is a fragmentary perspective view of an aerosol container equipped with an actuator in accordance with an exemplary embodiment of the present disclosure.
Figure 2:
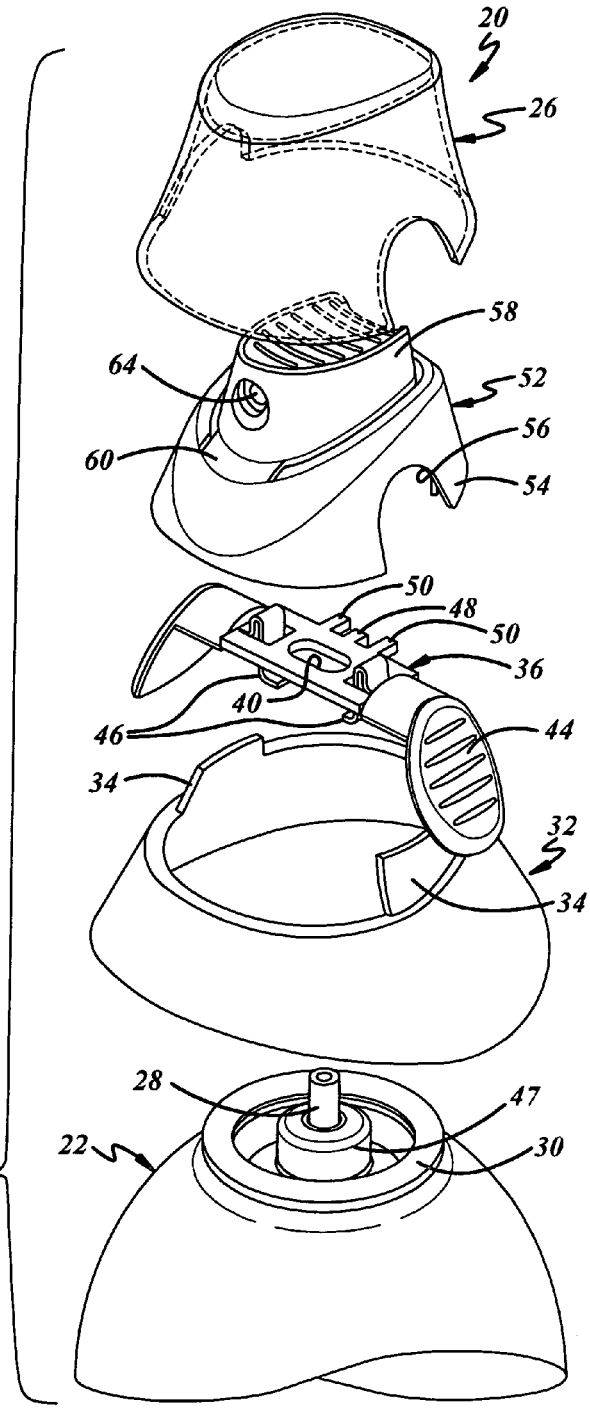
FIG. 2 is a fragmentary exploded perspective view of the container and actuator illustrated in FIG. 1.
Figure 3:
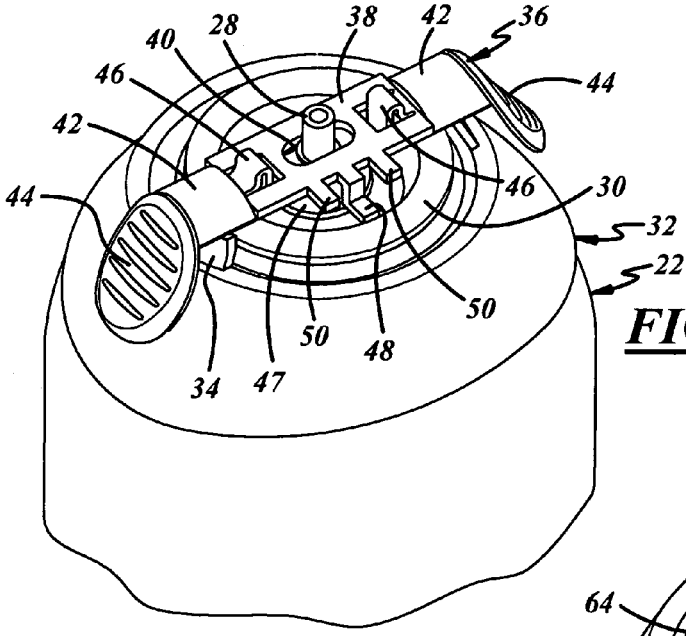
FIG. 3 is a perspective view of the package in FIGS. 1 and 2 with the cap and upper housing removed for purposes of illustration.

FIGS. 1-3 illustrate a package 20 in accordance with an exemplary embodiment of the present disclosure as including an aerosol container 22 with an actuator 24 and an overcap 26. Aerosol container 22, which can be a spray paint container for example, has an outlet valve with an extending valve stem 28 surrounded by a collar 47 and a radially spaced ring 30. Actuator 24 preferably includes a lower housing 32 that is received over the end of container 22 surrounding valve stem 28. Lower housing 32 may be of molded plastic construction, for example, and preferably has a pair of diametrically opposed upstanding legs 34.

A crossbar or slide 36 is slidably disposed on and carried by collar 47 of container 22. Crossbar 36 has a central body 38, which may be generally rectangular, with an elongated or slot-shaped center opening 40 received over valve stem 28. A leg 42 extends from each opposed end of center body 38 and a finger pad 44 is coupled to the remote end of each leg 42. A spring 46 is carried by crossbar center body 38 inwardly adjacent to each leg 42, preferably by being formed integrally with center body 38 of crossbar 36. Springs 46 in the exemplary embodiment internally engage ring 30 on container 22 for biasing crossbar 36 to a center first position illustrated in FIGS. 3 and 6B. As an alternative, the springs could engage collar 47 that surrounds valve stem 28. The springs could be made separately from crossbar 36 and assembled to the crossbar. A release tab 48 is carried by center body 38 of crossbar 36, preferably in lateral alignment with valve stem 28 at the centered position of the crossbar illustrated in FIG. 3. Crossbar 36 preferably also includes a pair of lock tabs 50 disposed on opposed sides of release tab 48. Lock tabs 50 preferably extend from crossbar center body 38. Crossbar 36, including springs 46, preferably is of one-piece integrally molded plastic construction.

Figure 4:
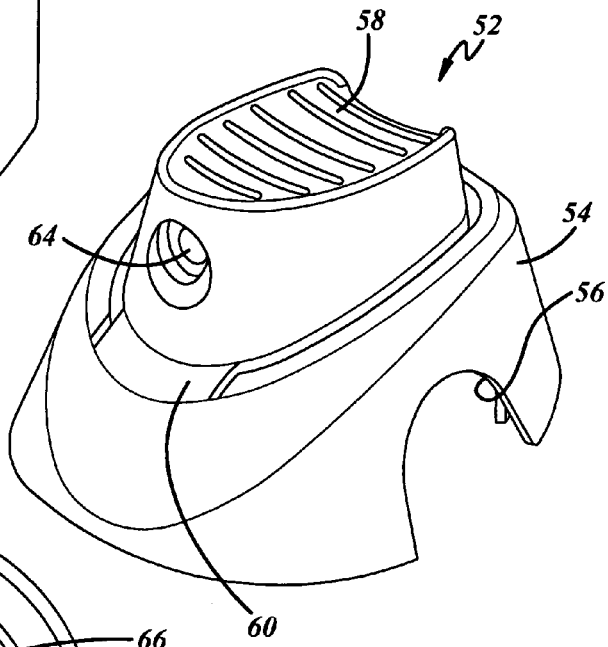
FIG. 4 is a perspective view of the upper housing in the package of FIGS. 1-3.
Figure 5:
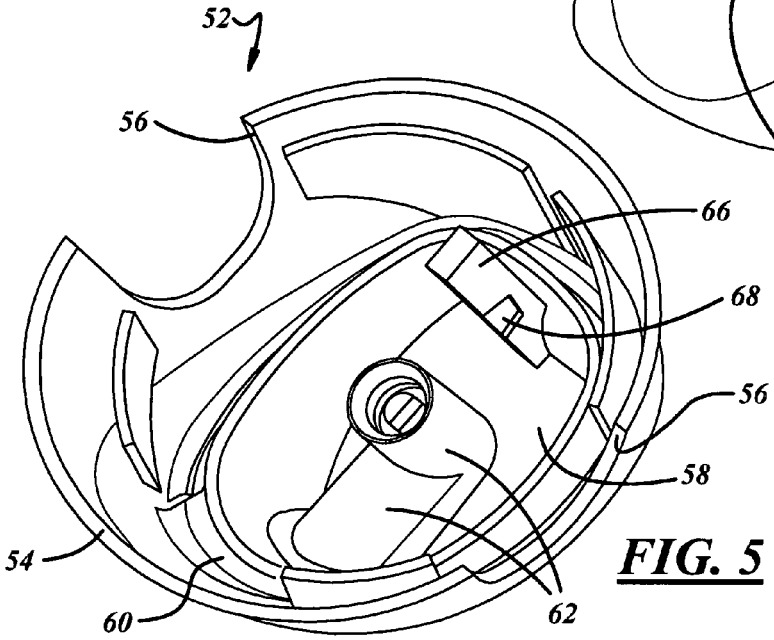
FIG. 5 is a perspective view of the interior of the upper housing in FIG. 4.

Actuator 24 also includes an upper housing 52, the details of which are best seen in FIGS. 4 and 5. Upper housing 52 includes a collar 54 having a pair of opposed side openings 56. Collar 54 may be secured by snap fit to lower housing 32 so as to enclose the center portion of crossbar 36, with the end portions of the crossbar extending through openings 56. Legs 34 on lower housing 32 partially block openings 56 in assembly as shown for example in FIG. 1. An actuator button 58 is carried by collar 54, preferably by being integrally molded with collar 54 and coupled to collar 54 by an integral or living hinge 60. One or more outlet tubes 62 on the underside of actuator button 58 are coupled in assembly to valve stem 28 and feed the contents of the container to an outlet opening 64 when actuator button 58 depresses valve stem 28. A boss or rib 66 extends from the undersurface of actuator button 58. As best seen in FIG. 6B, the free end of rib 66 overlies the free end of release tab 48 on crossbar 36 when the crossbar is in the first or centered position. Rib 66 has a pair of oppositely facing side notches 68 disposed on respective opposed sides of rib 66. When actuator button 58 is depressed, notches 68 are disposed to receive lock tabs 50 on crossbar 36, as will be described. Upper housing 52, including collar 54 and actuator button 58, preferably is of one-piece integrally molded plastic construction. Crossbar 36 is adapted to move side-to-side with respect to the direction of outlet opening 64.

Figure 6A:
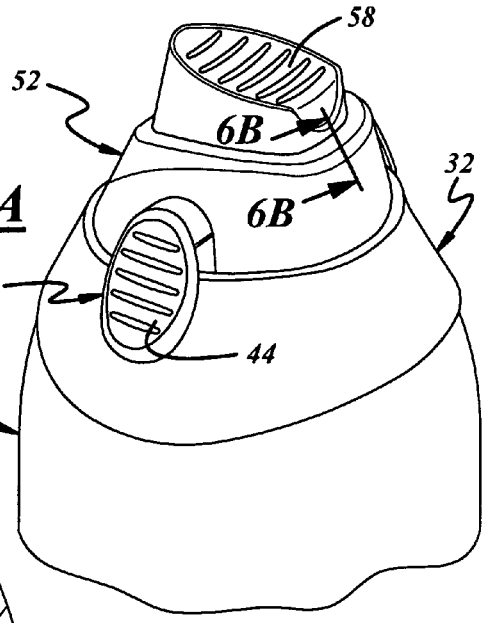
FIG. 6A is a perspective view of the actuator in a rest position.
Figure 6B:
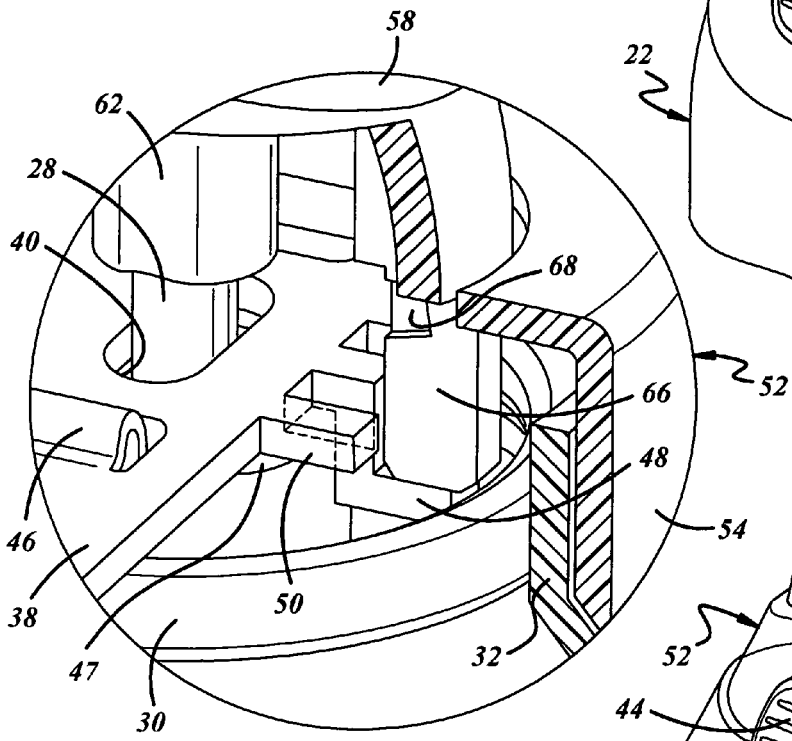
FIG. 6B is a fragmentary sectional view of the actuator in FIG. 6A.
Figure 7A:
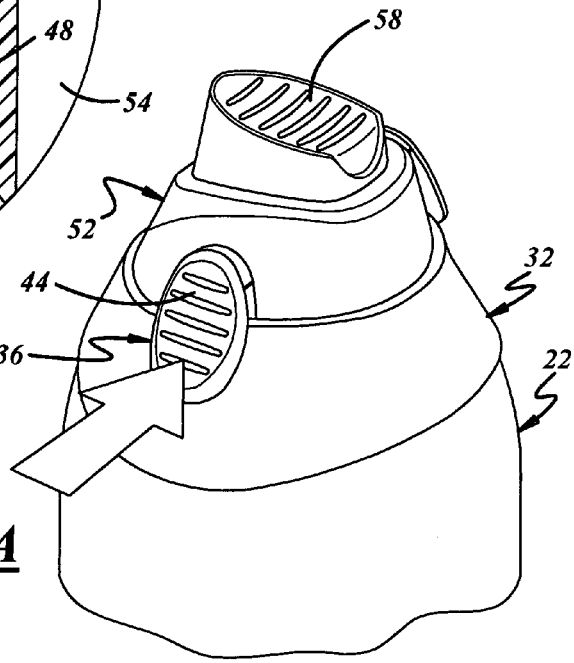
FIG. 7A is a perspective view of the actuator with the actuator button being released for depression.

FIGS. 6A and 6B illustrate the neutral or rest position of actuator button 58 and crossbar 36. Depression of actuator button 58 is inhibited by abutment of rib 66 against release tab 48, as shown in FIG. 6B. To release the actuator button, crossbar 36 is moved longitudinally from the center first position illustrated in FIGS. 3, 6A and 6B to a second position offset from the first position and illustrated in FIGS. 7A and 7B. (Inasmuch as crossbar 36 preferably is movable in both directions, there will be two spaced second positions of the crossbar on opposed sides of the center first position.) In this second position, release tab 48 on crossbar 36 has been moved out of the blocking position with respect to rib 66 on actuator button 58, so that the actuator button can now be depressed to depress valve stem 28 and thereby activate the outlet valve of aerosol container 22. This depressed or activated position is illustrated in FIGS. 8A and 8B, dispensing the contents of the container.

Figure 8A:
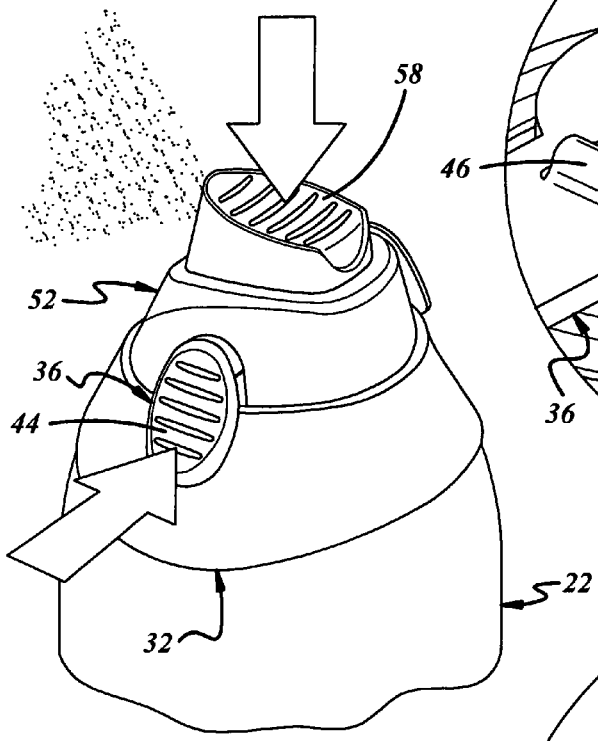
FIG. 8A is a fragmentary perspective view of the actuator with the actuator button released for depression.
Figure 7B:
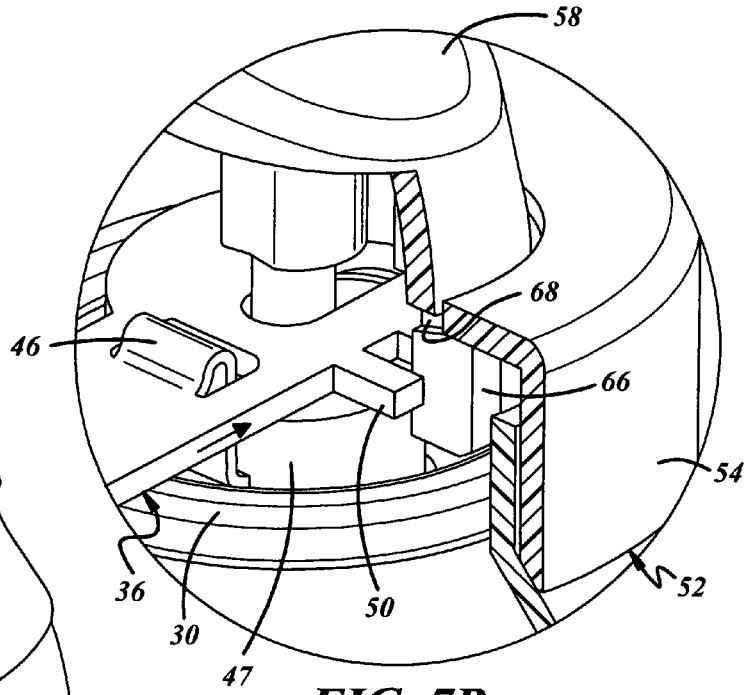
FIG. 7B is a fragmentary sectional view of the actuator in FIG. 7A.
Figure 8B:
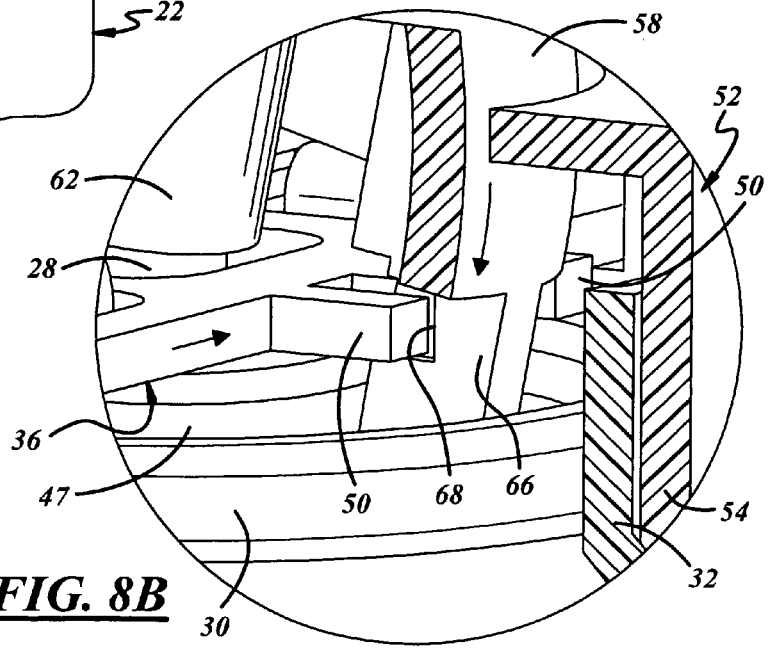
FIG. 8B is a fragmentary sectional view of the actuator in FIG. 8A.
Figure 9A:
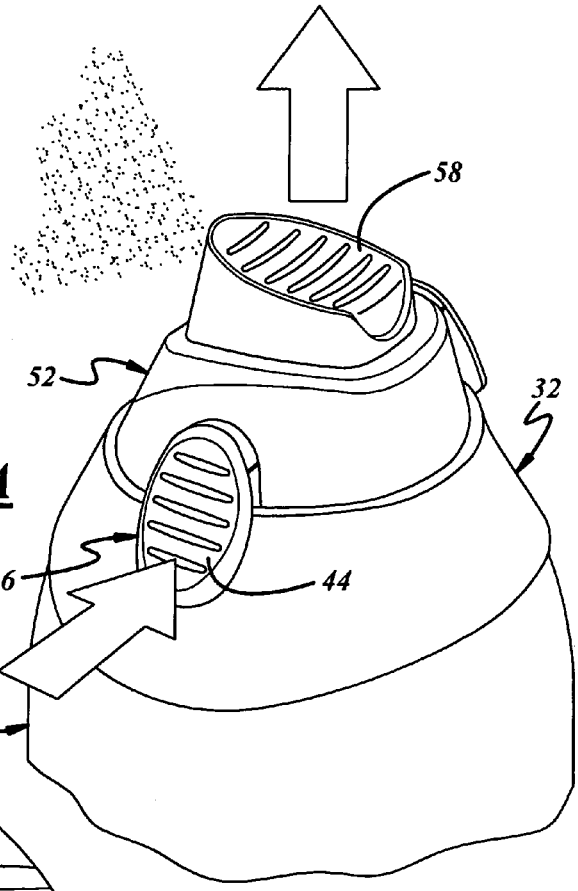
FIG. 9A is a fragmentary perspective view of the actuator in a depressed and locked position.
Figure 9B:
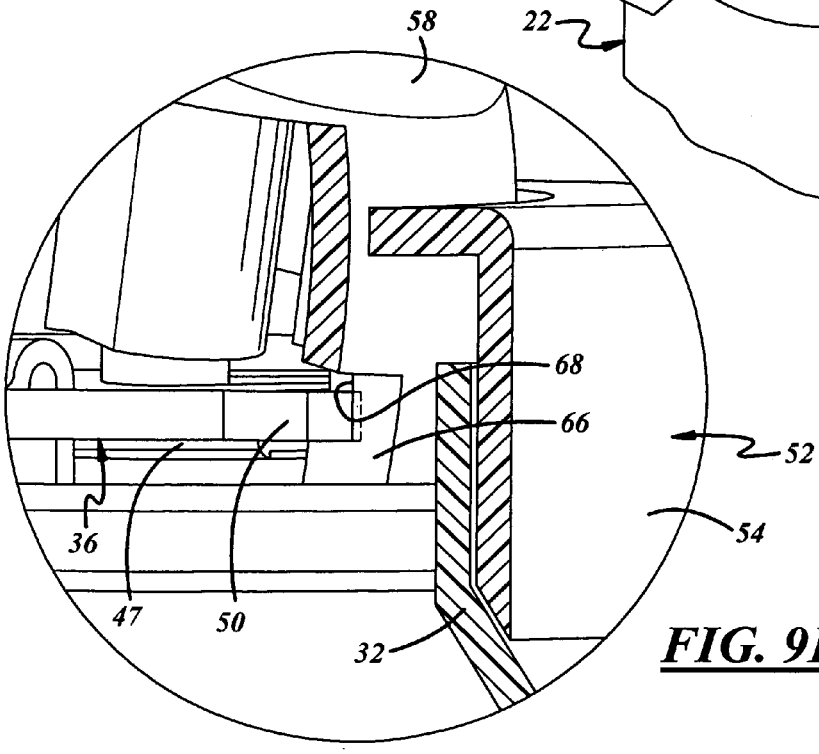
FIG. 9B is a fragmentary sectional view of the actuator in FIG. 9A.

In this depressed position of the actuator button illustrated in FIGS. 8A and 8B, crossbar 36 can be moved to a third position illustrated in FIGS. 9A and 9B spaced from the second position illustrated in FIG. 7B. (Again, inasmuch as crossbar 36 preferably can be moved longitudinally in both directions, there preferably are two such third positions of the crossbar respectively spaced outwardly from the two second positions and the center first position of the crossbar.) In this third position of crossbar 36, one of the lock tabs 50 on crossbar 36 moves into one of the notches 68 on rib 66. Disposition of a lock tab 50 within a notch 68 prevents movement of actuator pad 58, so that actuator pad 58 can be released by the user (FIG. 9A). (Again, there are spaced lock tabs 50 on crossbar 36 and opposed notches 68 on rib 66 so that actuator button 58 can be locked by movement of crossbar 36 in either direction.) Actuator pad 58 can then be released, as illustrated in FIG. 9A, while holding crossbar 36 in the locked position, which facilitates use by an operator. However, if crossbar 36 is released, springs 46 on crossbar 36 will urge the crossbar to the center first position, releasing finger pad 36 so that dispensing of aerosol product is terminated.

There thus has been disclosed an actuator for an aerosol container that fully satisfies all of the objects and aims previously set forth. The actuator has been disclosed in connection with an exemplary embodiment, and a number of modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. An actuator for an aerosol container having a valve with a projecting valve stem, said actuator including:

an actuator button having an outlet for coupling to the valve stem, and a crossbar for disposition between the container and said actuator button, said crossbar being movable with respect to the valve stem between at least a center first position blocking depression of said actuator button with respect to said valve stem and spaced second positions on opposite sides of said first position permitting depression of said actuator button with respect to said valve stem, wherein said actuator button has an internal rib and said crossbar has a release tab that blocks said internal rib in said first position of said crossbar and is spaced from said rib in said second positions of said crossbar, said rib has a pair of side notches facing in opposite directions, said crossbar has a pair of laterally spaced lock tabs on opposite sides of said release tab, and said crossbar is movable between said center first position, said spaced second positions, and spaced third positions on opposite sides of said second positions at which one of said lock tabs is received in a corresponding notch to lock said actuator button in a depressed position.

2. The actuator set forth in claim 1 wherein said crossbar has a center opening for receipt over the valve stem, and said release tab and said lock tabs extend laterally with respect to said center opening.

3. The actuator set forth in claim 2 including springs for engaging the container and biasing said crossbar to said center first position.

4. The actuator set forth in claim 3 wherein said springs are integrally formed with said crossbar.

5. The actuator set forth in claim 4 wherein said crossbar includes integrally formed finger pads on opposed ends of said crossbar.

6. The actuator set forth in claim 1 including at least one spring for engaging the container to bias said crossbar toward said center first position.

7. The actuator set forth in claim 6 wherein said at least one spring is integral with said crossbar.

8. The actuator set forth in claim 1 including a lower housing for surrounding the valve stem and an upper housing receivable on said lower housing for enclosing said crossbar, said crossbar extending through openings on opposed sides of said upper housing.

9. The actuator set forth in claim 8 wherein said actuator button is integrally coupled to said upper housing by a pivot hinge.

10. The actuator set forth in claim 9 wherein said lower housing has upstanding legs that partially block said openings in said upper housing.

* * * * *